US007350744B1

(12) United States Patent
Schwartz et al.

(10) Patent No.: US 7,350,744 B1
(45) Date of Patent: Apr. 1, 2008

(54) SYSTEM FOR CHANGING WARHEAD'S TRAJECTORY TO AVOID INTERCEPTION

(76) Inventors: Nira Schwartz, 2550 Pacific Coast Hwy., Torrance, CA (US) 90505; Richard Woods, 2550 Pacific Coast Hwy. # 68, Torrance, CA (US) 90505

( * ) Notice: Subject to any disclaimer, the term of this patent is extended or adjusted under 35 U.S.C. 154(b) by 64 days.

(21) Appl. No.: 11/359,849

(22) Filed: Feb. 22, 2006

(51) Int. Cl.
*F41G 7/00* (2006.01)
*F42B 15/01* (2006.01)
*F42B 15/00* (2006.01)

(52) U.S. Cl. ..... 244/3.15; 244/3.1; 244/3.11; 244/3.14; 89/1.11

(58) Field of Classification Search ..... 244/3.1–3.3; 89/1.11, 1.8, 1.1; 342/13–16, 61, 62, 357.01–357.17; 701/1, 3, 4, 13, 200, 207, 213–216, 224, 701/226
See application file for complete search history.

(56) References Cited

U.S. PATENT DOCUMENTS

| | | | | |
|---|---|---|---|---|
| 3,862,584 | A * | 1/1975 | Schmidt et al. | 89/1.8 |
| 3,905,563 | A * | 9/1975 | Nagoshi | 244/3.15 |
| 4,347,996 | A * | 9/1982 | Grosso | 244/3.16 |
| 5,071,087 | A * | 12/1991 | Gray | 244/3.15 |
| 5,619,010 | A * | 4/1997 | Holm et al. | 89/1.11 |
| 5,637,826 | A * | 6/1997 | Bessacini et al. | 244/3.11 |
| 5,828,571 | A * | 10/1998 | Bessacini et al. | 244/3.11 |
| 6,006,145 | A * | 12/1999 | Bessacini | 244/3.1 |
| 6,467,721 | B1 * | 10/2002 | Kautzsch et al. | 244/3.11 |
| 6,889,935 | B2 * | 5/2005 | O'Dwyer | 244/3.21 |

OTHER PUBLICATIONS

Internet Website: www.niraschwartz.com.

Letter dated Oct. 3, 1994; ARMY. www.niraschwartz.com/n_korea_threat.htm.

Case 96-3065 RSWL Apr. 1996; Nira Schwartz. www.niraschwartz.com/case_96_3065%rswl.htm.

Army Scop of Work, 1992; ARMY. www.niraschwartz.com/army_scope_of_work.htm.

Poet Study 1998-5, POET. www.niraschwartz.com/mit_II_false_reports.htm.

Statement of Work for Exhoatmospheric Kill Vehicle (EKV) Mar. 28, 1995;ROCKWELL Int. www.niraschwartz.com/wally_beitzel_deposition.htm.

(Continued)

*Primary Examiner*—Bernarr E. Gregory

(57) ABSTRACT

A system for increasing a warhead's chance of hitting a target comprises a system for causing the warhead to deviate from its projected trajectory so that it will have an increased chance of avoiding intercepting force such as a kill vehicle a missile, an airplane, an explosive gun, a laser gun, an electron gun, radiation gun, a particles gun, a fire gun, a jet air gun, and/or a remote control guided explosive. The warhead has one or more thrusters, which cause it to deviate from its projected trajectory. An on-board computer controls the thrusters' ignition and burning time in a closed loop with an on-board Global Positioning System (GPS) unit. The GPS data is used for predicting the warhead's trajectory and to assure that the thrusters provide motion displacements of the warhead. In the event the GPS unit fails, the warhead computer and controller can be overridden by an off-board remote control. If both GPS and remote control units fail, the warhead can drop to a random mode of controlling the thruster's ignition and burning time and/or select one thruster that will tumble the warhead in space.

12 Claims, 7 Drawing Sheets

OTHER PUBLICATIONS

Hon. Congressman H. Berman Press release Apr. 2, 2006; Berman. www.niraschwartz.com/hon__congressman__h__berman.htm.

NMD-My-Copyrights Nov. 2005; Nira Schwartz. www.niraschwartz.com/nmd-my-copyrights.htm.

* cited by examiner

Fig 1 – Prior Art

| | |
|---|---|
| 1. | Call_sense_thruster_fuel(414,413,412,411)<br>Call_interface_414(ignite=4, time=5, fuel=on)<br>Call_interface_413(ignite=3, time=5, fuel=on)<br>Call_interface_412(ignite=2, time=5, fuel=on)<br>Call_interface_411(ignite=1, time=3, fuel=on)<br>Exit |
| 2. | Call_sense_thruster_fuel(414,413,412,411)<br>Call_interface_414(ignite=4, time=5, fuel=on)<br>Call_interface_413(ignite=3, time=5, fuel=on)<br>Call_interface_412(ignite=2, time=5, fuel=on)<br>Exit |
| 3. | Call_sense_thruster_fuel(414,413,412,411)<br>Call_interface_414(ignite=4, time=5, fuel=on)<br>Call_interface_413(ignite=3, time=5, fuel=on)<br>Exit |
| 4. | Call_sense_thruster_fuel(414,413,412,411)<br>Call_interface_414(ignite=3, time=5, fuel=on)<br>Exit |
| 5. | Call_sense_thruster_fuel(414,413,412,411)<br>Call_interface_413(ignite=3, time=5, fuel=on)<br>Exit |
| 6. | Call_sense_thruster_fuel(414,413,412,411)<br>Call_interface_412 (ignite=2, time=5, fuel=on)<br>Exit |
| 7. | Call_sense_thruster_fuel(414,413,412,411)<br>Call_interface_411 (ignite=1, time=3, fuel=on)<br>Exit |

Fig 6

SYSTEM FOR CHANGING WARHEAD'S TRAJECTORY TO AVOID INTERCEPTION

BACKGROUND

1. Field of the Invention

This invention relates generally to military warheads, specifically to improving the ability of warheads to survive, i.e., to reach a target. It also relates to video, simulation games, simulated battlefield scenarios, security systems on airplanes, and car accident prevention.

2. Prior Art

A warhead is a projectile that may contain a conventional explosive(s), germs, nuclear bomb(s), propaganda, equipment, nuclear debris, and/or conventional bombs. A warhead may be empty, so that it is serves as a decoy. The warhead may be shaped like any of the following: sphere, cone, barrel, pyramid, helicoids, box, continuous chain, any combinations of these, etc. Its body can be made of light materials, such as cloth, and/or a solid material, such as aluminum, steel, etc. A warhead's size can range from several centimeters to tens of meters and its weight can range from less than kilogram to thousands of kilograms.

Warheads usually travel at a high altitude, such as the exo-atmospheric range (over 30 km high) where there is little or no air, and/or at a lower atmospheric range. It is extremely important that the warhead reach the target without being destroyed during its travel or knocked off course by a kill vehicle, i.e., an intercepting missile and/or by a laser beam. Both warheads and kill vehicles can be launched from a missile, space shuttle, space ship, satellite, ocean-going ship, sea carrier, submarine, airplane, and/or silo. The kill vehicle is designed to intercept the warhead and destroy it (or knock it off course) by direct kinetic impact or, by a proximity or contact explosion. It is also possible to destroy a warhead with a laser gun, located at one of the above locations, by directing a laser beam at the warhead to destroy it by heat or ablation. A Space-Based Laser gun is called an ABL (Air Born Laser), while a Ground-Based Laser gun is called a GBL. A laser gun has a servomechanism that requires 5 to 10 seconds to align its beam to the target. In that time period the warhead's trajectory is assumed accurately predicted otherwise the laser beam will miss it. Thus the intercepting force with the warhead can be a kill vehicle, a missile, an airplane, an explosive gun, a laser gun, an electron gun, a particles gun, a fire gun, a jet air gun, a radiation gun, and/or a remote control guided explosive.

The kill vehicle has an on-board computer that mathematically extrapolates and predicts the warhead's trajectory and space coordinates during the kill vehicle travel in space. Extrapolation in time is made using prior space coordinate data collected from the warhead during its travel. This prior data is collected by equipment on-board the kill vehicle, such as radar, video, sensors, IR (infra-red) cameras, and laser beams.

A kill vehicle has on-board equipment which after launch views and acquires or obtains the warhead's space coordinates and calculates the trajectories of both projectiles for the purpose of interception. The kill vehicle has on-board thrusters that adjust its trajectory in space. To obtain an interception, the trajectories of both the kill vehicle and the warhead must cross each other or intersect at an interception point. If the kill vehicle has acquired the warhead's space coordinates and trajectory, but these change, the kill vehicle requires a response time to acquire and change direction in response to the warhead's change of coordinates. This response time to change direction is usually 5-10 seconds and is called a "time-to-go period" (TTG). The kill vehicle's TTG is in part due to its inertia. During the TTG period the kill vehicle's trajectory in space is fixed and cannot be changed. This gives the warhead an advantage, i.e., five-seconds to change its trajectory away from the predicted interception point by at least half of its body dimension, causing the kill vehicle and/or the laser beam to miss it.

A known method of extrapolation based on prior known data is disclosed in U.S. Pat. No. 4,852,129, issued Jul. 25, 1989 to co-inventor Nira Schwartz. The warhead moves relatively slowly in space, allowing accurate prediction of its space coordinates, resulting in approximately a 50% probability of destruction by the kill vehicle. But this is considered a poor probability in lieu of the cost and military war needs. In effort to increase this probability, save warheads from loss, and increase probability of their survival, they were given a mechanical spin called a "coning motion" where the warhead's axis moves with time in space to trace the surface of a virtual cone, or tumbling motion, and/or a combination of these. But kill vehicles were still able to predict the warheads' position with a fair degree of accuracy.

ADVANTAGES

Accordingly, one advantage of one aspect of the invention is to provide system for improving a warhead's survival probability and ability to avoid a kill vehicle, and/or laser gun, and hit its target.

Further advantages of one or more aspects of the invention will become apparent from a consideration of the ensuing description and the accompanying drawings.

SUMMARY

In accordance with the invention, several propelling thruster devices, their fuel tanks, and ignition mechanisms are mounted on a warhead. Alternatively off-the-shelf, cost-effective propelling gas generators similar to those used in car air bags, can be used. Current off-the-shelf thrusters have an ignition time of 10 milliseconds, i.e., the time needed to have the thruster fully operational. The thruster's burning time, in which short deflecting forces or pulses of motion are provided to the warhead, is between 1 second to 5 minutes, depending upon the amount of fuel on board. The on-board and/or off-board computer algorithms control both ignition and burn time. Communication with an off-board computer is accomplished through the use of an on-board receiver-transmitter. The off-board computer can override the on-board computer to take over control of its operation.

In an additional mode of operation, the on-board computer's algorithms select a random thruster ignition and burning duration.

The thrusters cause the warhead to undergo a sudden change in trajectory, breaking the kill vehicle's ability and/or the intercepting force ability to accurately predict its future space coordinates. To assure a miss, a Global Positioning System (GPS) unit is mounted on the warhead to provide the on-board and off-board computers with the warhead's space coordinates. The computer algorithms can ignite additional thrusters and/or prolong their burning time to assure a warhead trajectory displacement adequate to cause a miss. The on-board computer encrypts the GPS data to assure security.

When a warhead travels in the exo-atmosphere, it usually takes about 30 minutes to travel from launch to the target. This gives the warhead 360 possible consecutive 5-second TTGs. If one thruster pulse is provided to the warhead during each TTG, it may result in 360 thruster pulses that change its trajectory. Multiple thruster pulses during a TTG will increase trajectory deviation from the predicted trajectory and the warhead's probability of reaching the target.

Off-the-shelf thrusters are available with a capability of 5 seconds to 30 minutes burn time. They require 10 milliseconds of ignition time and are capable of over 360 starts. Such a thruster weighs about 3 kilograms. A warhead with six thrusters will provide approximately a 98% probability that the kill vehicle, and/or the laser gun, will miss the warhead. The more thrusters with more power and/or gas generators the warhead has, the better the chances for its survival.

DRAWINGS

Figures

FIG. 6 shows an example of look up table (LUT) with thrusters control commands, as used in the warhead.

DETAILED DESCRIPTION

Figure 1:
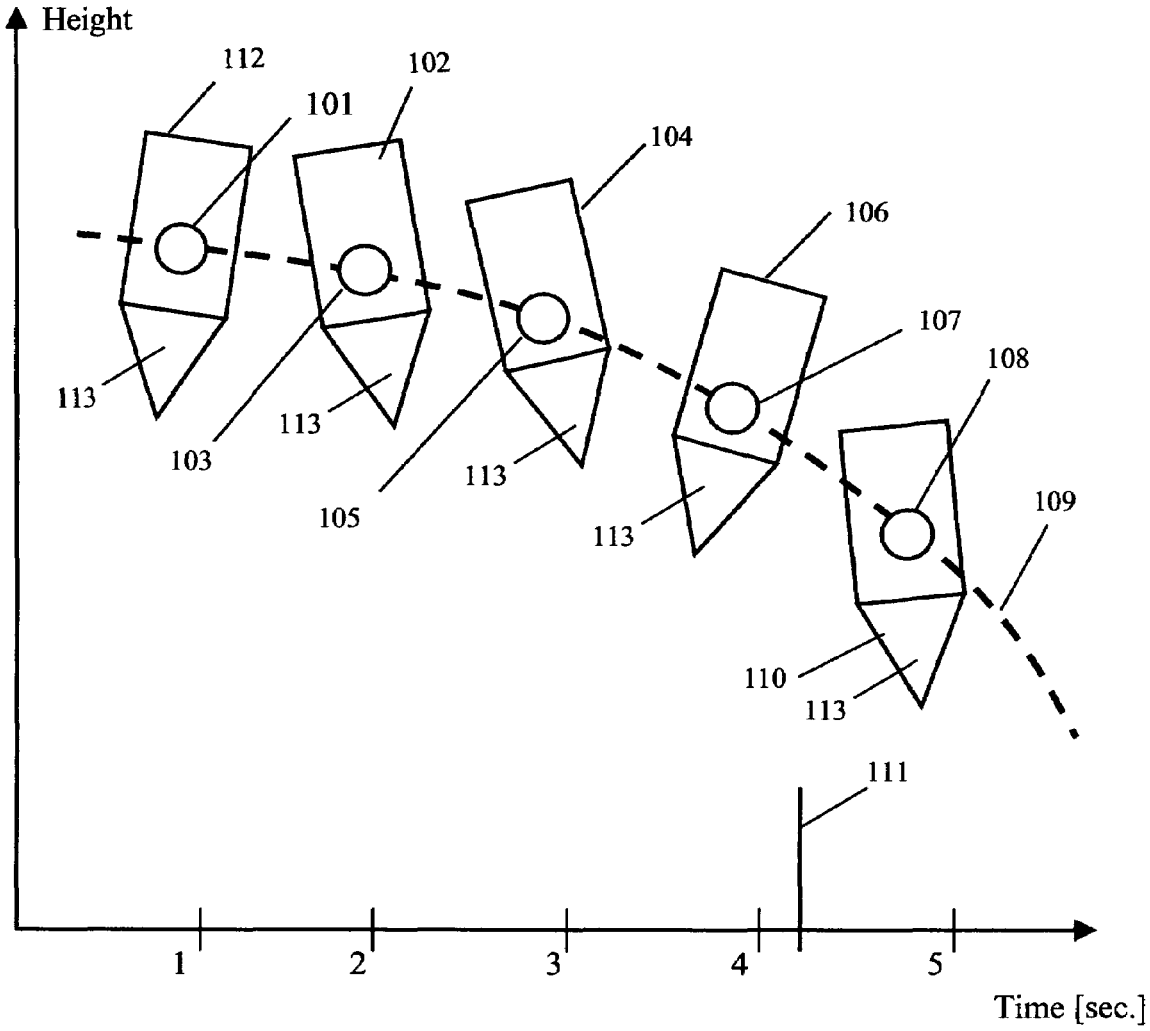
FIG. 1 shows a prior-art warhead's trajectory (without on-board thrusting devices) as viewed by a kill vehicle.

Prior Art—Warhead Trajectory—FIG. 1

FIG. 1 shows a space trajectory with sequential space positions of a prior-art (non-thrusting) warhead 113. The last TTG starts at time 111. The positions of warhead 113 are shown as viewed by a kill vehicle (not shown). The warhead's positions during the one to four seconds prior to time 111 are shown at 112, 102, 104, and 106 on trajectory 109. The kill vehicle calculates possible interception points with the warhead with some degree of uncertainty, as represented by circles 101, 103, 105, and 107. At the beginning of last TTG 111, the kill vehicle's on-board computer (not shown) uses interception points 101, 103, 105, and 107 to extrapolate a future warhead location 110 and interception point 108. At time 111 the kill vehicle's trajectory is fixed. Prior to travel (impact or detonation) the warhead was given a mechanical coning motion, shown as deviations of its alignment from the vertical axis, at positions 112, 102, 104, 106 and 110. I.e., the warhead is tilted away from and back to its previous orientations with respect to the vertical axis at these five positions.

Since the kill vehicle has calculated interception point 108, its computer directs it to point 108 where it will intercept and destroy the warhead. Based on experience, there is a 50% probability that the kill vehicle will intercept the warhead.

Figure 2:
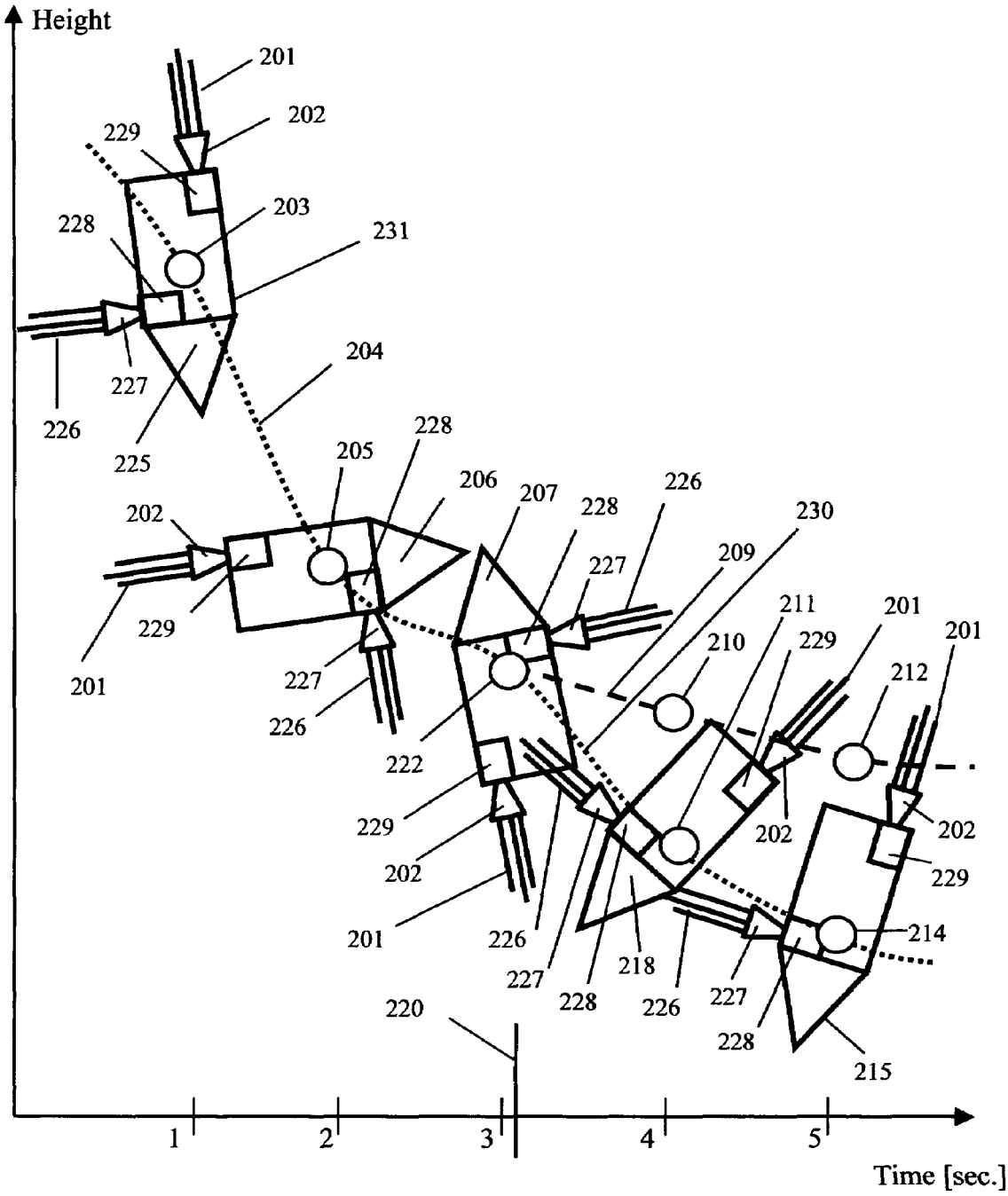
FIG. 2 shows the trajectory of a warhead with two thrusters in accordance with the invention as viewed by the kill vehicle.

Inventive Trajectory—FIG. 2

FIG. 2 shows sequential space positions and a trajectory in space of a space-launched (air-to-air or air-to-ground) thrusting warhead 231 in accordance with the invention prior and during start 220 of the last TTG, as viewed by the kill vehicle (not shown). The warhead has in a preferred embodiment six thrusters, but for simplicity of illustration only two thrusters 202 and 227 are shown, together with their exhausts 201 and 226, their fuel tanks, ignition units, and interface units 229 and 228, respectively;

Off-the-shelf thrusters are available which incorporate a monopropellant liquid fuel in a tank, an electronic valve, a catalyst screen, a combustion chamber, and an expansion nozzle. The electronic valve opens and shuts by computer command, and releases the fuel through the catalyst screen to combustion chamber. The catalyst ignites the fuel in the combustion chamber where it expands and leaves through the expansion nozzle as exhaust gas. The thrusters are physically mounted on the warhead in such a way that their exhausts are perpendicular to each other. Since there are six thrusters, by proper control they can move the warhead in any direction in space.

The other four thrusters (not shown) have a similar mechanism. During the entire trajectory, the warhead's on-board computer (322 in FIG. 3) controls by LUT (404 in FIG. 4, and FIG. 6) the ignition, the fuel flow, and the burning time of all of the thrusters, including thrusters 202 and 227. During its trajectory the warhead 231 advances through positions 225, 206, 207, 218, and 215.

The kill vehicle calculates possible interception points with the warhead with some degree of uncertainty, as represented by circles 203, 205, and 222. Trajectory 204 (containing points 203, 205, and 222) and its continuation trajectory 230 (containing points 222, 211 and 214) are the warhead's trajectory, created as a result of all the thrust pulses applied to it during its travel. Thrust pulses by the thrusters at time 220 cause the warhead's trajectory to deviate from space coordinates 210 to 211, instead of coordinates 210 to 212 through which the warhead would have proceeded if these pulses were not applied. These pulses cause the warhead to travel through actual trajectory 230. Trajectory 230 and its predecessor trajectory 204 lie on the following possible interception points on the warhead's body: 203, 205, 222, 211, and 214.

The kill vehicle's on-board cameras and/or sensors monitor the warhead's trajectory. At the beginning of the last TTG 220, the kill vehicle's on-board computer (known but not shown) extrapolates warhead's trajectory 204 (containing points 203, 205, and 222) and predicts trajectory 209 and interception points 210 and 212. This kill vehicle is not aware that thrusters 202 and 227 were activated and thrust pulses at time 220, causing the warhead to deviate its trajectory from 209 to trajectory 230. For simplicity the drawing shows only three possible interception points.

The kill vehicle continues assume trajectory 204-209 is valid as he kill vehicle enters the last TTG. The kill vehicle predicted this trajectory, based on its view of the warhead's prior space coordinates. The kill vehicle's assumption of this trajectory is final and cannot be changed. As can be seen, predicted interception space coordinate 212 is far from the actual space coordinate 214, so the kill vehicle will miss. Trajectory 209 is significantly different from trajectory 230 because the warhead's thrust pulses after time 220 were too late in time to be incorporated by the kill vehicle's extrapolation and prediction algorithms.

The more pulses of thrust the thrusters provide during the entire travel of the warhead, the higher the probability that the kill vehicle will assume that the warhead has a different trajectory than its actual trajectory and miss the warhead. Thus the thrusters cause the warhead to have an irregular, unpredictable trajectory.

Figure 3:
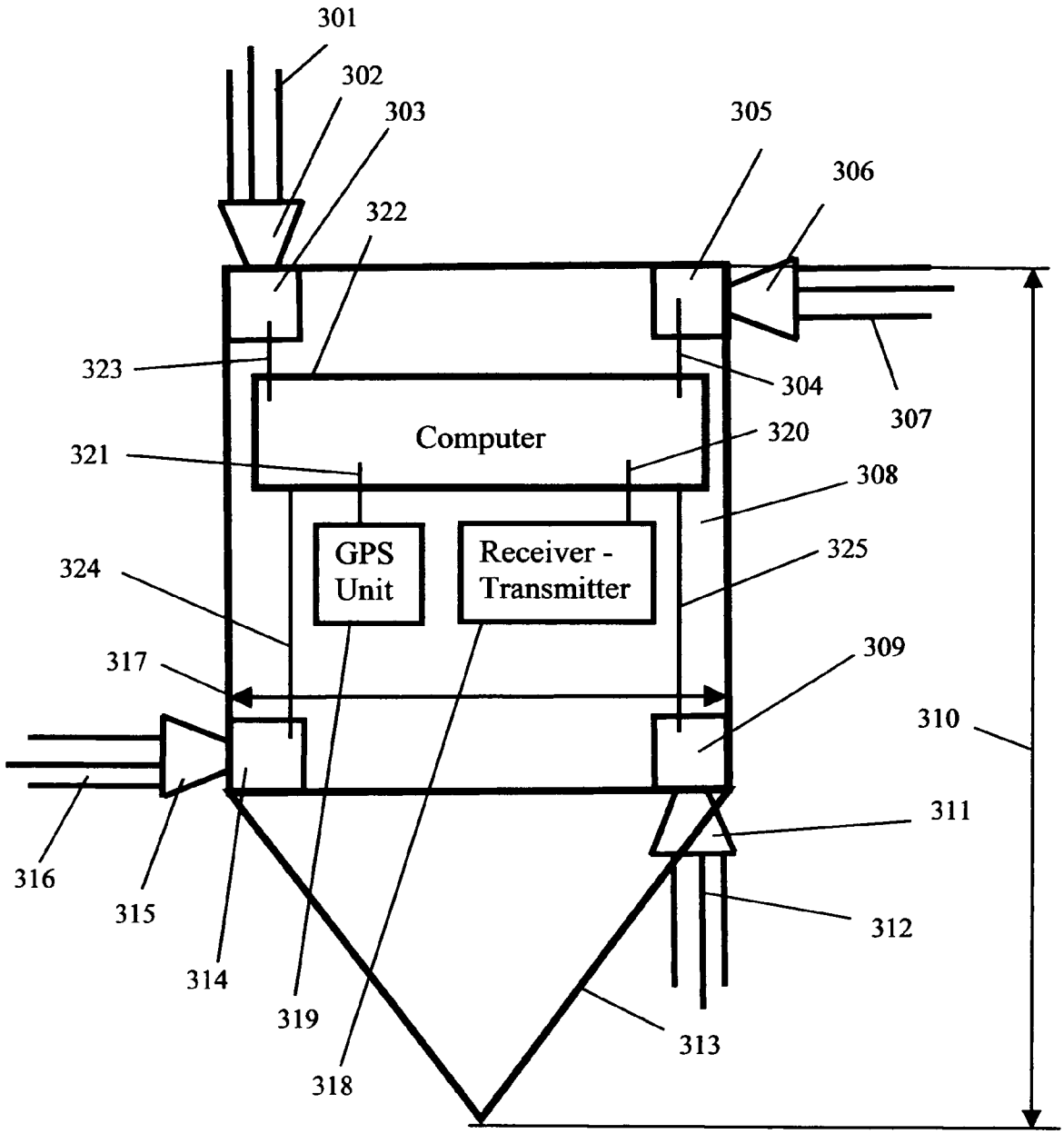
FIG. 3 shows the warhead and its on-board equipment.

Warhead—FIG. 3

FIG. 3 shows a block diagram of the components in warhead 313. Warhead 313 is shown equipped with four thrusters 302, 306, 311, and 315 although six (or even more)

are preferred. The warhead in FIG. 2 was shown as equipped with only two thrusters. The thruster's ignition mechanism, fuel tanks, and their electronic interface with computer 322 are shown as boxes 303, 305, 309, and 314. The thrusters' exhausts are shown as 301, 307, 312, and 316.

In operation, the computer sends a command to the thrusters' electronic interface, which causes the valves to open and release fuel from the fuel tanks to pass through the catalyst, which causes the fuel to ignite, changing it into an expanding gas in the combustion chamber, from which it proceeds to the expansion nozzle, which it leaves as exhaust gas. The thrusters are physically mounted on to the warhead's container in such a way that their exhausts are perpendicular to each other, creating thrust pulse components perpendicular to each other. This enables the warhead to be moved in any space direction. Computer 322 is located in the warhead and by communication links 323, 304, 325, and 324 controls the thrusters' fuel flow, ignition, and burning time to cause deviations in the warhead's trajectory. Computer 322 uses communication bus lines 304, 323, 324, and 325 to send commands to the selected thrusters' electronic interfaces to open and shut the electronic valves in the thrusters, and establish burning time according to commands stored in the LUT (404 in FIG. 4).

A suitable off-the-self computer 322 uses an Intel Pentium 4 chip, with a memory for calculations and storage of 8 megabytes and an EPROM of 25 megabytes to store the LUT commands, with a USB (Universal Small bus) for communications. The warhead also incorporates an on-board receiver-transmitter unit 318. The receiver-transmitter is an off-the-shelf UART (Universal Asynchronous Receiver Transmitter) chip.

Receiver-transmitter unit 318 receives commands from a system in an airplane, a satellite, a spaceship, ground controllers, a submarine, a ship, and/or a missile. These are called "off-warhead" locations. The receiver-transmitter unit communicates with computer 322 by link 320. The information received may override the on-board programs and change the thruster's ignition, burning time, and the amount of fuel flow to it.

GPS unit 319 is an off-the-shelf unit, such as are made by Garmin Inc. The GPS unit outputs digital data that continuously provides the space coordinates of the warhead in a predetermined format. The unit has an antenna to receive satellite signals so that it can continuously compute and indicate its space location. Each GPS 319 has 12 internal receivers to allow communications with 12 satellites and accurately determine the space coordinates of the warhead within few centimeters.

GPS unit 319 provides warhead space coordinates to computer 322 by communication link 321, and to an off-board computer (not shown but at one or more off-warhead locations) by communication link 320 and transmitter 318. Both computers use the GPS data to extrapolate the warhead's future trajectory, similar to the way the kill vehicle does (FIGS. 1 and 2). Both computers calculate the deviation from the on-board extrapolated trajectory and the warhead's location provided by the GPS unit. In case the deviation is less then half of the warhead's dimensions, a thruster is selected in accordance of pre-planed selection located in a LUT (Look Up Table) stored in both computer memories. A suitable LUT is shown in FIG. 6. The deviation operates as a pointer to a location in the LUT table. A LUT is a computer memory where computer commands are stored. A pointer to a location within the LUT table will cause the computer to perform the specific command indicated by the pointer. The LUT command will select the thruster to be ignited, its fuel flow, and its burning time. The selected thruster is ignited and burned to provide a thrust pulse to the warhead. This assures a miss by creating a deviation from the on-board extrapolated trajectory and the warhead's location by at least half of the warhead's dimensions.

The thruster's performance is monitored by the use of GPS data as feedback. If the warhead's location, as reported by the GPS data, will not assure a miss, meaning the above deviation is less then half of the warhead's dimension, the fuel flow to the thruster is increased, and/or additional thrusters are ignited. The deviation is used as a pointer to a location in the LUT, which identifies a stored command to select a thruster and/or thrusters to be ignited. The LUT's stored commands are determined by ground simulation for the warhead's travel and the thrusters' performance. In this ground simulation the thrusters are ignited while the warhead in on the ground its thrust is measured and validated. The results are downloaded as a chain of commands into the LUT in computer 322 prior to the warhead's travel. The GPS data is encrypted by on-board computer 322, and/or by GPS unit 319. The encrypted data is also transmitted via transmitter 318 to the off-board computers as a feedback to remotely control the warhead's movement and motions. If the on-board GPS fails, the on-board computer's controlling commands can be overridden by off-board commands received by warhead receiver 318.

The wireless communications between electronic components use off-the-shelf technology that can be purchased as electronic digital chips. Digital chips are basic elements but need to be connected and programmed. Wireless communication can be substituted for wire communication between the on-board units, including computer 322, thrusters 302, 306, 311, and 315, receiver-transmitter unit 318, and GPS unit 319. A D-Link card bus will provide wireless access.

In the event GPS unit 319 fails to perform, the off-board computer (not shown but at one or more off-warhead locations) will override on-board computer 322 and take control over the thruster's performance. On-board computer 322 can also simulate GPS data by the use of a random number generator. If both the GPS unit and the off-board computer fail, the on-board computer randomly controls the thruster's performance. The warhead's length is indicated by dimension 310 and its width by dimension 317. Its upper body 308 can be a cylinder, a box, a balloon, a sphere and combinations of that. Some times an attachments such as chain and/or additional balloon is connected to the warhead body 308 to complicate it motion while traveling.

While FIG. 3 shows a single on-board GPS unit for providing the warheads' continuous sequential space coordinates, three GPS units preferably are mounted on the warhead. These are spaced from one another by at least one meter to provide its three-dimensional movement in space. The use of a plurality of GPS units is known for measuring and monitoring three-dimensional movement of cranes. This plurality of GPS units on a warhead (not shown) will accurately indicate its space deviation from the predicted trajectory, increasing the probability for a miss.

Figure 4:
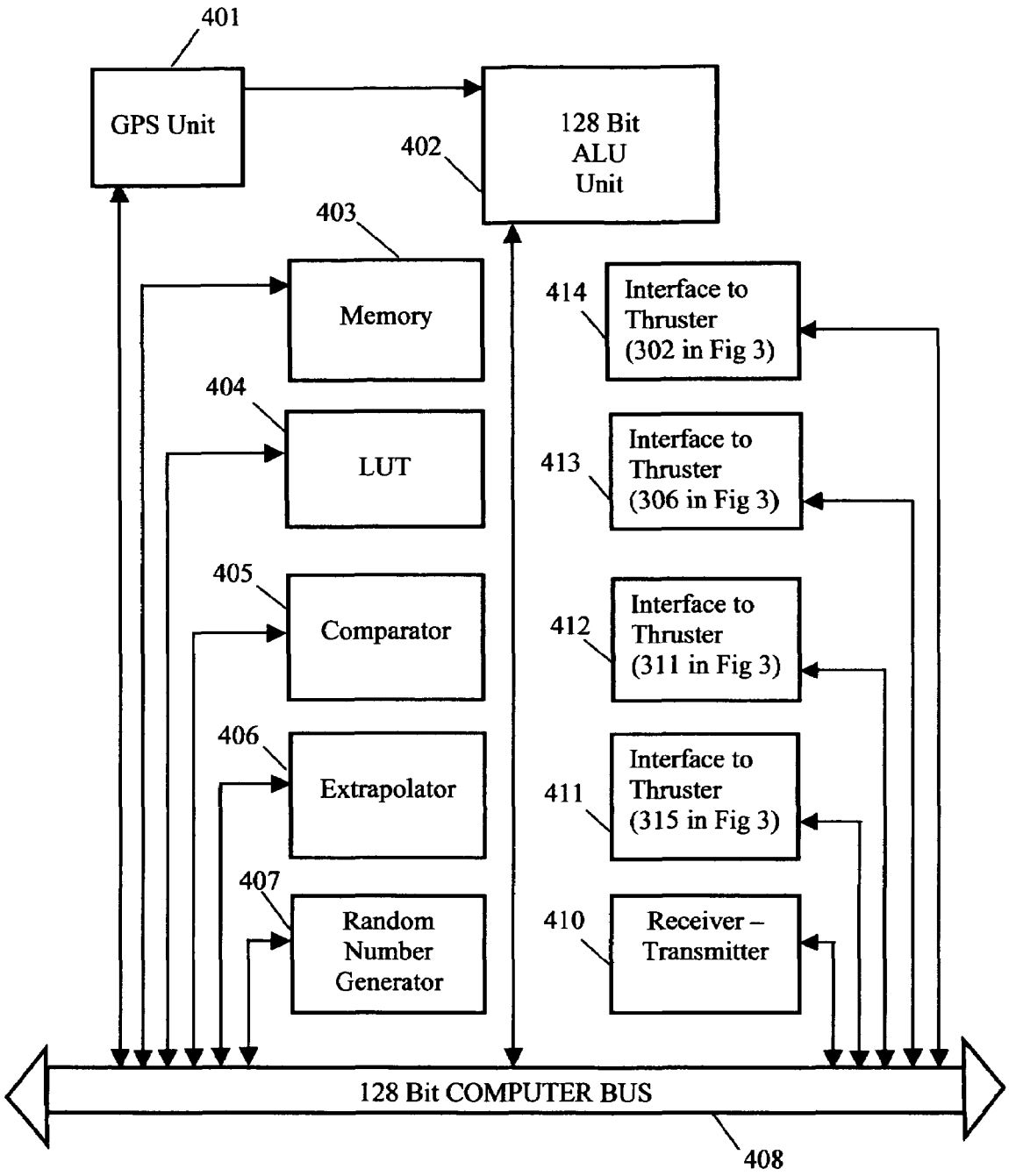
FIG. 4 shows a block diagram of the warhead's on-board computer.

Block Diagram—FIG. 4

FIG. 4 shows a block diagram of computer 322 of FIG. 3. The computer contains an Arithmetic Logic Unit (ALU) 402, a memory 403, a Look Up Table (LUT) 404, a comparator 405, an extrapolator 406, a pseudo random number generator 407, (called a random number generator for short) and a computer bus 408. Communications and data transfer between any and all logic units is done via bus 408.

GPS 401 continuously samples the warhead's space coordinates every 1 second or less, with an accuracy of centimeters. The GPS unit provides the space-coordinate information via bus 408 in digital form to ALU 402. ALU 402 uses bus 408 to provide the data to extrapolator 406, to receiver-transmitter 410, to comparator 405, and stores the GPS data in memory 403.

Transmitter 410 sends the GPS data to selected off-board locations. Prior to transmitting the GPS data by use of transmitter 410, it is encrypted by the ALU 402. Encryption algorithms are in public domain and can be stored in the computer's memory.

Extrapolator 406, upon receiving the GPS data, continuously extrapolates and predicts new warhead space coordinates. The predicted new space coordinates are sent via bus 408 to ALU 402. The ALU in turn uses bus 408 to send the new space coordinates in digital form to comparator 405.

Comparator 405 continuously compares the GPS data with the predicted new space coordinates for a given time, by subtracting the two values. The comparison results are in digital form and are passed to the ALU unit by the use of bus 408, and the ALU transfers it to LUT 404. Comparator 405 is an off-the-shelf chip produced by Motorola and/or Texas Instruments.

LUT 404 uses the comparison results to point to a location in the table. The information in the LUT table is sent to the ALU via bus 408. ALU 402 then uses bus 408 to pass the LUT information to the relevant one or several thruster interfaces 411, 412, 413, and 414 (303, 305, 309, and 314 in FIG. 3). The LUT information passed to the relevant interface also contains the burning time for each relevant thruster and the fuel flow control. The sequence of thruster ignitions is randomly selected and downloaded into the LUT prior to the warhead's launch. Ground simulations are performed. The thrusters' burning time, fuel flow, and the thrust they produce are measured and validated prior to the warhead's travel. It is done by actual ignition of the thrusters thrust simulations and validations done prior to the warhead's travel while still on the ground. The results are downloaded as sequence of commands stored in a LUT located in the computer's memory.

Upon receiving new GPS data, the ALU compares it with the prior information stored in memory 403. In the event there is no change in the GPS data, the ALU acquires, via bus 408 and from receiver 410, the current GPS data that replaces GPS unit 401.

Upon receiving off-board GPS data, the ALU compares it with the prior information stored in memory 403. In the event there is no change in the GPS data, the ALU acquires (via bus 408) a random number generated by unit 407 to replace the failed GPS data.

The likelihood that a kill vehicle will miss interception with the warhead is scientifically improved and reaches 98%.

Figure 5:
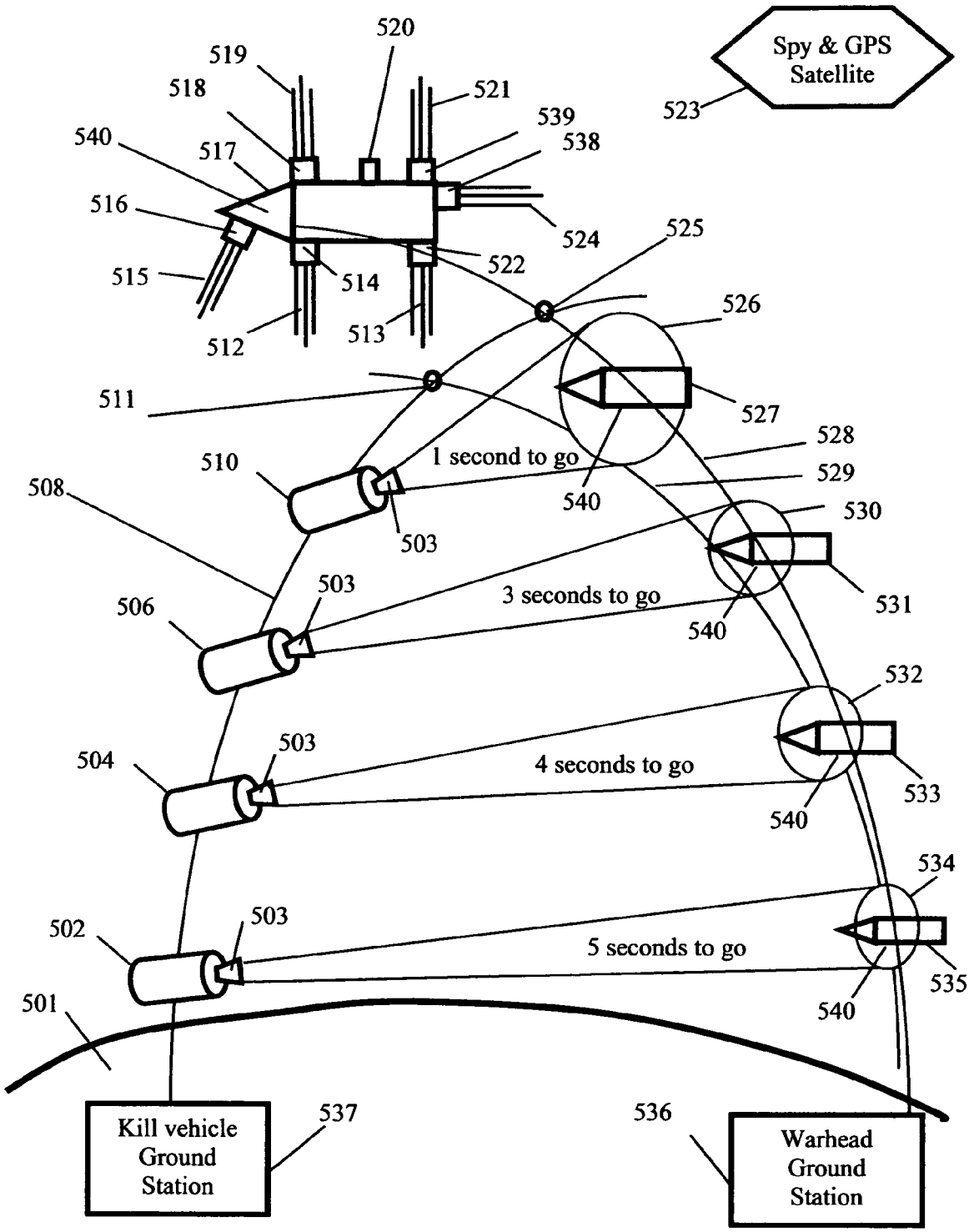
FIG. 5 shows global and ground stations of the warhead's and kill vehicle's systems.

Ground and Space Station—FIG. 5

FIG. 5 shows the ground and space stations and the warhead's and kill vehicle's trajectories. A kill vehicle ground station 537 and a warhead ground station 536 are positioned on earth 501. A warhead 540 is launched from ground station 536 in a missile (not shown) and is ejected out at high altitude, such as the exo-atmosphere. Upon ejection the warhead has the speed of the missile, e.g., about 10,000 Km/hr. The thrusters mounted on the warhead can provide thrust pulses to change this primary motion after ejection.

The warhead's positions in successive TTGs are shown at 535, 533, 531, and 527, at 5, 4, 3, and 1 second(s) prior to the kill vehicle's predicted interception point 511, on predicted trajectory 529. The kill vehicle's positions are shown at 502, 504, 506, and 510 on its trajectory 508. The kill vehicle's trajectory 508 during that last TTG is fixed, and cannot be changed. The warhead's thrusters were ignited during the last TTGs and deflected the warhead's trajectory from 529 to 528. When the kill vehicle reaches predicted interception point 511, warhead 540 is away from this point by over half of its body size and locates at point 525. E.g., if the warhead is 100 cm long it will be deflected from its original predicted interception point 511 by over 50 cm. When the kill vehicle reaches interception point 525, warhead 540 is at point 517. Thus the kill vehicle misses the warhead, and a proximity explosion only deflects the warhead away from its trajectory. The warhead's six thrusters are shown at 516, 518, 539, 538, 522, and 514; their exhausts are shown at 515, 519, 521, 524, 513, and 512 respectively. The warhead's thrusters at locations 535, 533, 531, and 527 are not shown.

Spy and GPS satellite 523 communicates with the warhead's GPS unit 520 to provide it with its continuous, sequential space coordinates. When GPS unit 520 is below the height of satellite 523, as shown, the space coordinates are directly provided. When the warhead is ejected from the launch missile in the exo-atmosphere, above the height of satellite 523, GPS unit 520 should be a special military unit, equipped with special receivers capable of working at that range, where the signal is weaker and space coordinates are reversed. The kill vehicle, shown in successive positions 502, 504, 506, and 510, uses its camera 503, and its successor fields of view 534, 532, 530, and 526, respectively, to store in their on-board memory the warhead at positions 535, 533, 531, and 527. The kill vehicle uses its spy satellites, and its radar (not shown) to evaluate the warhead's space coordinates.

The warhead's ground station 536 also incorporates an off-board computer, and an off-board receiver-transmitter to provide a backup in case warhead's on board GPS unites 520 fails. In that case, the warhead's space coordinates are collected by radars (not shown) and transmitted by ground station 536 to the warhead's on-board receiver (not shown), to override the failed GPS unit.

Look Up Table (LUT)—FIG. 6

FIG. 6 shows an example of LUT table and its list of commands that control the selections, ignitions, the burning time, and fuel flow of four thrusters 302, 306, 311, and 315 mounted on warhead 308 (in FIG. 3). The left column of the table shows 1 to 7 possible entrances to the table. Each entrance has a different set of commands that take place in the computer 322 (FIG. 3). The deviation calculated by comparator 405 (FIG. 4) operates as a pointer to select an entrance to the table. When the deviation pointer is less then 1/7 of the warhead's dimension, it points to the first entrance on the LUT table. When the deviation pointer is less then 2/7 of the warhead's dimension, it points to the second entrance on the LUT table, and so on.

The first command on the first entrance to the LUT table calls for a subroutine named "Call_sense_thruster_fuel (414, 413,412,411)". This subroutine acquires the amount of fuel in tanks 303, 305, 309, and 314 (FIG. 3), through thruster interface 414, 413, 412, and 411 (FIG. 4), and validates that enough fuel is in each tank to ignite and burning relevant thrusters 302, 306, 311, and 315.

If this is indeed the case the algorithms continue to call for subroutines named: "Call_interface_414(ignite=4, time=5, fuel=on)". This subroutine has three parameters. The first parameter is named: "ignite" and its value equals to the thruster selected. In this example thruster #4 (302 in FIG. 3) was selected by the use of its interface (414 in FIG. 4). The third parameter named "fuel" was set to "on" and opens the electronic valve of thruster #4 for fuel flow and a 5-second fuel burning time as the "time" parameter.

The next command in the first entrance in the LUT calls the subroutine "Call_interface_413(ignite=3,time=5, fuel=on)". It opens the electronic valve of thruster #3 (306 in FIG. 3) through its interface (413 in FIG. 4) for fuel flow and a 5-second of fuel burning. Subroutine "Call_interface_412(ignite=2, time=5, fuel=on)" opens the electronic valve of thruster #2 (311 in FIG. 3) through its interface (412 in FIG. 4) for fuel flow and a 5-second of fuel burning. Subroutine "Call_interface_411(ignite=1, time=3, fuel=on)" opens the electronic valve of thruster #1 (315 in FIG. 3) through its interface (411 in FIG. 4) for fuel flow and a 3-second of fuel burning. Then the algorithms exit the LUT table and control is returned to ALU 402 (in FIG. 4). Ground simulations found thruster #1 (315 in FIG. 3) to be the strongest thruster, and it was ignited only for 3 seconds.

In the event that subroutine "Call_sense_thruster_fuel (414,413,412,411)" validates that fuel tank of thruster #4 is empty, the subroutine jumps to entrance #7 in the LUT table where only thruster #1 will be activated. The same takes place when the fuel tanks of thrusters #3 and #2 are empty. However this situations is unlikely to happen since the fuel tanks of the thrusters are designed to be large enough to independently thrust the warhead for at least 360 pulses of 5 seconds each.

If the global positioning system mounted on board and/or at off-warhead locations fail, ALU unites 402 sets the deviation pointer of comparator 405 (FIG. 4) to be equaled to 5/7, which will activate thruster #3 and cause the warhead to tumble.

If subroutine: "Call_sense_thruster_fuel(414,413,412, 411)" finds that fuel tank of thruster #3 is empty, the subroutine jumps to entrance #6 at the LUT where only thruster #2 is activated, causing the warhead to tumble.

In lieu of the LUT table shown, other selections of controlling commands can be used to control warhead to avoid interception.

Figure 7:
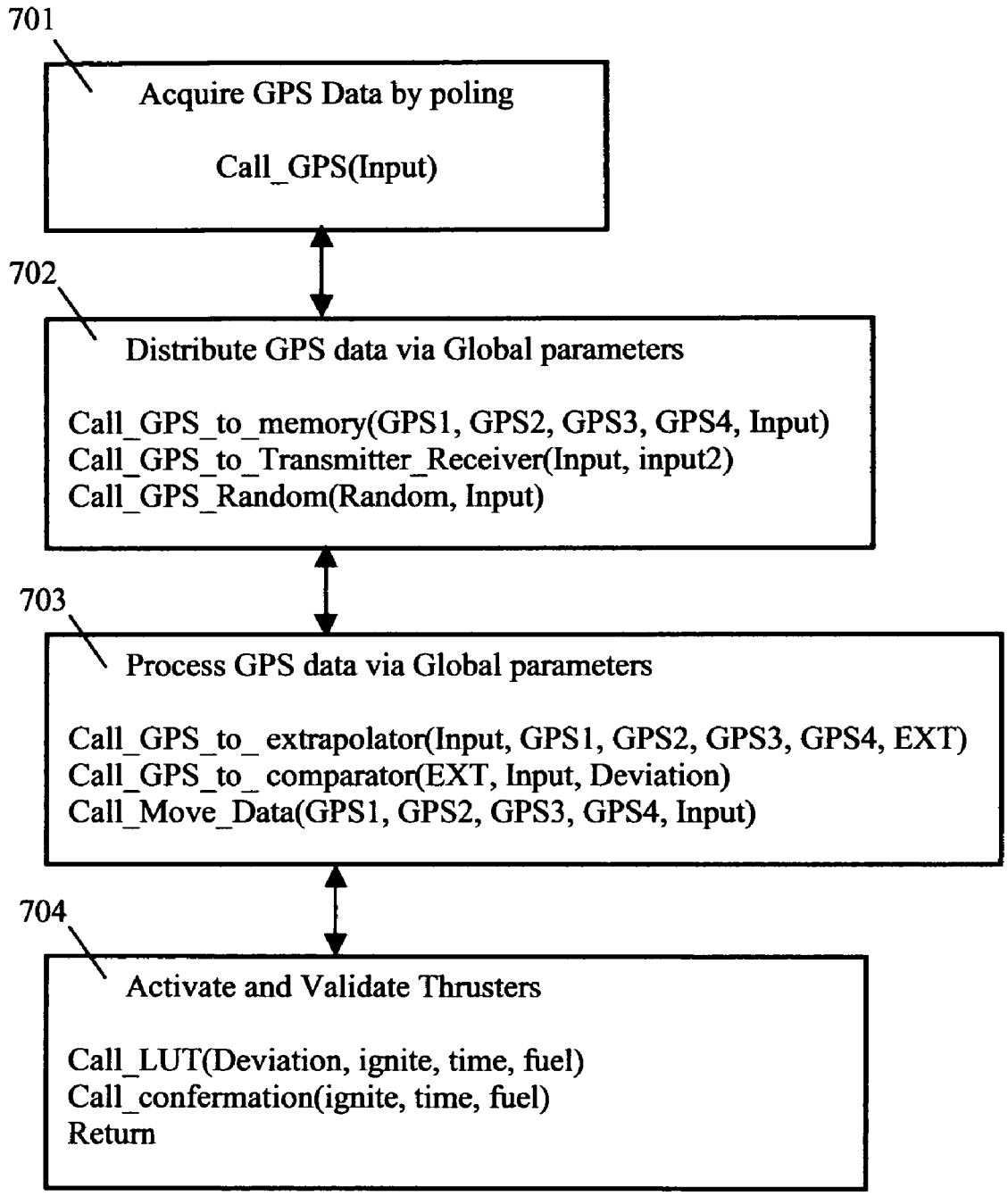
FIG. 7 shows an example warhead's algorithms flowchart.

Algorithm Flowchart—FIG. 7

FIG. 7 shows a flowchart of algorithms that control operation of the warhead's travel in space. The flowchart has four groups of subroutines. Group 701 acquire GPS data (unit 401 in FIG. 4), by calling the subroutine Call_GPS (Input). This subroutine continuously loops, waiting for new GPS data, a process called poling. The new data is stored as a parameter named: "input". It is a digital value acquired every 1 second or less. The parameter "input" and its value are defined as type global, which means that they are available to any and all other subroutines at any time.

Group 702 downloads the value stored in "input" into a vector by calling subroutine "Call_GPS_to_memory(GPS1, GPS2, GPS3, GPS4, input)". In this example the vector is of dimension 5 identified by type global parameters "GPS1", "GPS2", "GPS3", "GPS4", and "input". These parameters store the five past consecutive GPS data.

Then the algorithms continue to call for subroutines named "Call_GPS_to_Transmitter_Receiver(Input, input2) ", which transmit the "input" value via unit 410 (FIG. 4) to the off-warhead locations. This subroutine also receives via receiver 410 the warhead's space coordinates as viewed by off-warhead locations and stores the value in parameter "input2". This subroutine also subtracts the value stored in "input" from the value stored in parameter "GPS4". If the absolute value is less than warhead's dimension (which means that the on board GPS unit failed) then the parameter "input" is loaded with the value stored in parameter "input2". Two consecutive values stored in "input2" are subtracted one from the other to validate the quality of the off-warhead's location data. If the absolute value of the subtraction is less than warhead's dimension, which means that the off-board GPS unit failed, then the algorithms calls for a subroutine named "Call_GPS_Random(Random, Input)" (unit 407 in FIG. 4) to replace the value stored in parameter "input" with the value stored in parameter "Random", that was generated by the random number generator. Otherwise the algorithms continue to Group 703.

Group 703 calls for subroutine "Call_GPS_to_extrapolator(Input, GPS1, GPS2, GPS3, GPS4, EXT)" (unit 406 in FIG. 4). This subroutine extrapolates space coordinates stored in parameters "GPS1, GPS2, GPS3, and GPS4" defined as type global, and stores the extrapolation results in a parameter named: "EXT" defined as type global.

Then the algorithms continue to call subroutine named "Call_GPS_to_comparator(EXT, Input, Deviation)" (unit 405 in FIG. 4). The subroutine stores in parameter "Deviation" defined as type global the absolute value of the subtraction between the values stored in parameter "EXT" and parameter "Input". Then the algorithms continue to call subroutine "Call_Move Data(GPS1, GPS2, GPS3, GPS4, Input)". This subroutine moves the data stored in parameter "GPS2" to be stored in parameter "GPS1", the data stored in parameter "GPS3" to be stored in parameter "GPS2", the data stored in parameter "GPS4" to be stored in parameter "GPS3", and the data stored in parameter "Input" to be stored in parameter "GPS4". All such movement is done to preserve data stored in "input" from being destroyed by future GPS data that will be acquired by group 701.

Group 703 calls for subroutine name "Call_LUT(Deviation, ignite, time, fuel)" (unit 404 in FIG. 4). The value stored in parameter "Deviation" is a pointer to a LUT as identified in FIG. 6. The values stored in parameters "ignite, "time" and "fuel" are produced as an output by this subroutine. Then algorithms calls for the subroutine "Call_confermation(ignite, time, fuel)". If parameter "fuel" stores a value greater the zero, the algorithms return to the beginning at group 701 to acquire additional GPS data. Otherwise the deviation pointer is set to point to the last entry on the LUT, which causes the warhead to tumble.

The execution time of all algorithms must be faster than the time between two consecutive acquisitions of GPS data. In this example the time must be is faster than one second, which is no problem since current off-the-shelf technology is much faster than that.

CONCLUSION, RAMIFICATIONS, AND SCOPE

Accordingly the reader will see that, according to the invention, I have provided a method and apparatus to improve the probability from 50% to 98% that a kill vehicle will miss the warhead so that the warhead will reach its target.

I have also provided a closed feedback loop by having the warhead access GPS data to change its space coordinates to control fuel flow, ignition, and burning time of thrusters to assure a miss.

The remote method controls fuel flow, ignition, and burning time of the thrusters to assure a miss in case the GPS unit fails, or in case the GPS and off-board computers fail.

The method also predicts future warhead locations by extrapolating GPS data, and uses this data to deflect the warhead to obtain a miss. It predicts the warhead's future location in effort to duplicate the kill vehicle's predictions, and uses this data to obtain a miss.

The method causes the warhead to be displaced away from its predicted space coordinates by over its half dimension to obtain a miss.

In the event GPS and/or off-board computer fails back-up approaches are activated to obtain a miss. By having the on-board computer simulate GPS data, the probability of miss is increased.

The method controls on board thrusters by the use of GPS data and secures the warhead's position by encryption of the GPS data.

The method and apparatus provide an alternative, cost-effective approach of replacing the thrusters by cost-effective solid fuel gas generators.

While the above description contains many specificities, these should not be construed as limitations on the scope of the invention, but as exemplifications of the presently preferred embodiments thereof. Many other ramifications and variations are possible within the teachings of the invention. For example a random selection of thrusters is also a possibility. An additional mode of operation can be employed where a continuous burning thruster will cause the warhead to tumble. The launched missile can alternatively carry the warhead to the final target. In that case the thrusters are connected to the body of the launched missile. The use of solid fired fuel gas such as used for car air bag instead of liquid fuel thrusters will provide similar results. Additional example, the system and method can be used in video games, target practice, battlefield simulations, and security systems on airplanes. The present system, in addition to enabling a warhead to evade a kill vehicle, also enable it to avoid other intercepting force, such as a laser beam, an electron beam, a particles beam, radiation beam, an airplane, an explosive beam, a fire beam, a jet air beam, and a remote control guided explosive.

Thus the scope of the invention should be determined by the appended claims and their legal equivalents, and not by the examples given.

The invention claimed is:

1. A method for causing a launched warhead to deviate from its predicted trajectory, comprising;

providing a warhead with a propulsion thruster having an igniter and a fuel source;

mounting on said warhead a global positioning system unit for continually determining said warhead's space coordinates;

storing said space coordinates in an on-board computer in said warhead;

extrapolating said space coordinates by using said on-board computer to obtain a predicted trajectory of said warhead;

comparing said predicted trajectory of said warhead with said global positioning system space coordinates using said on-board computer and storing said comparison in a memory; and controlling said propulsion thruster to thrust said warhead from its predicted trajectory to cause said comparison to be larger than a dimension of said warhead so that an intercepting force will tend to miss said warhead.

2. The method of claim 1, further including providing an on-board transmitter to transmit said warhead's space coordinates as determined by said global positioning system unit to an off-board computer for determining the space coordinates of said warhead on a continual basis and for extrapolating said data and said comparison.

3. The method of claim 1, further including providing an on-board receiver that can receive commands for overriding said on-board computer.

4. The method of claim 1, further including providing a look up table and using said comparison to point to a location in said look up table to control said propulsion thruster in accordance with a value at said location in said look up table.

5. The method of claim 1, further including providing a random number generator and creating simulated global positioning system data using said random number generator and overriding said global positioning system space coordinates with said simulated global positioning system data.

6. The method of claim 1, further including determining if said global positioning system unit fails and causing said warhead to tumble and spin in the event of failure of said global positioning system unit.

7. An apparatus for causing a launched warhead to deviate from its predicted trajectory, comprising;

a warhead with a propulsion thruster having an igniter and a fuel source;

a global positioning system unit mounted on said warhead for continually determining said warhead's space coordinates;

a storage unit for storing said space coordinates in said warhead;

of an on-board and an extrapolator for extrapolating said space coordinates by using said on-board computer to obtain a predicted trajectory of said warhead;

a memory and a comparator for comparing said predicted trajectory of said warhead with said space coordinates determined by said global positioning system unit using said on-board computer and storing said comparison in said memory; and a controller for controlling said propulsion thruster for thrusting said warhead from its predicted trajectory for causing said comparison to be larger than said warhead's dimensions so that an intercepting force will tend to miss said warhead.

8. The apparatus of claim 7, further including an on-board transmitter for transmitting said space coordinates determined by said global positioning system unit to an off-board computer for determining the space coordinates of said warhead on a continuous basis, and for extrapolating said coordinates and said comparison.

9. The apparatus of claim 7, further including an on-board receiver that can receive commands for overriding said on-board computer.

10. The apparatus of claim 7, further including a look-up table and a pointer for pointing to a location in said look up table, said look up table being arranged to control said propulsion thruster in accordance with a value at said location in said look up table.

11. The apparatus of claim 7, further including a random number generator and means for creating simulated global positioning system data using said random number generator and overriding said global positioning system space coordinates with said simulated global positioning system data.

12. The apparatus of claim 7, further including a propulsion thruster for causing said warhead to tumble and spin in the event of failure of said global positioning system unit.

* * * * *